US006631573B1

(12) United States Patent
Alba

(10) Patent No.: US 6,631,573 B1
(45) Date of Patent: Oct. 14, 2003

(54) CALENDAR PLANNING SYSTEM

(76) Inventor: Hedelita G. Alba, 648 Concord Pl., Pleasanton, CA (US) 94566-7916

( * ) Notice: Subject to any disclaimer, the term of this patent is extended or adjusted under 35 U.S.C. 154(b) by 0 days.

(21) Appl. No.: 10/252,164

(22) Filed: Sep. 23, 2002

(51) Int. Cl.[7] ..... G09D 3/10
(52) U.S. Cl. ..... 40/118; 40/107; 40/110
(58) Field of Search ..... 40/118, 117, 107, 40/110

(56) References Cited

U.S. PATENT DOCUMENTS 2,686,985 A * 8/1954 Shore ..... 40/118
3,290,812 A * 12/1966 Hunkins ..... 40/107
3,810,322 A * 5/1974 Ritchie ..... 40/107
3,911,606 A * 10/1975 Hunkins ..... 40/110
4,216,596 A * 8/1980 Brown ..... 40/118
4,241,526 A * 12/1980 Poritz ..... 40/110
5,295,319 A * 3/1994 Jabbar ..... 40/107
5,799,423 A * 9/1998 Malino ..... 40/107
5,813,539 A * 9/1998 DePalma ..... 40/107

* cited by examiner

*Primary Examiner*—Gary Hoge

(57) ABSTRACT

Calendar Planning System with a housing including flat front and rear panels, side panels, a bottom and top panel. The housing has within it a plurality of horizontally disposed belts and associated pulleys having regularly spaced indices printed on them. The front panel of the housing has a plurality of apertures that allow the indices to appear through the apertures. The front panel is constructed of a ferrous metal material and coated with a write on wipe off surface. The front panel is divided graphically into five rows, each row containing seven boxes. Thirty-one of those boxes represent the days of the month. One side panel has openings that allow thumb wheels mounted on the pulleys to protrude thereby allowing the user to advance or retract the belt thereby advancing or retracting the indices that appear through the front panel apertures. Activity indicating color coded icons each have a magnetic back allowing them to adhere to the front panel.

4 Claims, 4 Drawing Sheets

CALENDAR PLANNING SYSTEM

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of calendars and more specifically to a calendar planning system. Calendars of various designs have been used by people for thousands of years to mark daily, monthly or weekly events. Modern calendars are often created so that a month of a year is represented on each page and the user replaces the page with a new on after each new month begins. Many modern calendars also can act as daily planners in that a plurality of graphic boxes are printed on the monthly calendar page so that a user can write down activities and or times of various events within each daily box as needed. Unfortunately, the process of writing down daily activities can be time consuming, especially since activities that may occur on a regular monthly basis have to be re-written each month as the new page is exposed. Additionally, it is time consuming to have to physically write down each activity, especially since the space provided in the average monthly planning calendar is limited. Finally, if a family of two or more people is trying to use the same planning calendar, it can be confusing to read and determine who the activity is referring to and how many family members may be involved in the activity.

BRIEF SUMMARY OF THE INVENTION

The primary object of the invention is to provide a calendar planning system that helps family's organize and record monthly activities.

Another object of the invention is to provide a calendar planning system that allows a single monthly page to be easily transformed to accommodate all twelve months.

Another object of the invention is to provide a calendar planning system that includes a series of icons that allow users to indicate activities without writing them down.

A further object of the invention is to provide a calendar planning system that is portable and can be hung on a flat surface such as a wall.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed calendar planning system comprising: a housing including flat front and rear panels, side panels, a bottom and a top panel. The housing having within it a plurality of horizontally disposed belts and associated pulleys. The belts having regularly spaced indices printed on them. The front panel of said housing having a plurality of apertures that allow said indices to appear through said apertures. The front panel being constructed of a ferrous metal material and coated with a write on wipe off surface. The front panel being divided graphically into five rows, each row containing seven boxes. Thirty-one of those boxes represent the days of the month. The side panel having a series of rectangular openings that allow thumb wheels mounted on said pulleys to protrude thereby allowing the user to advance or retard said belt thereby advancing or retarding said indices that appear through said front panel apertures. A plurality of icon retaining bins are located at the bottom of said housing. A plurality of activity indicating color coded icons stored in the bins each have a magnetic back allows them to adhere to said front panel.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Figure 1:
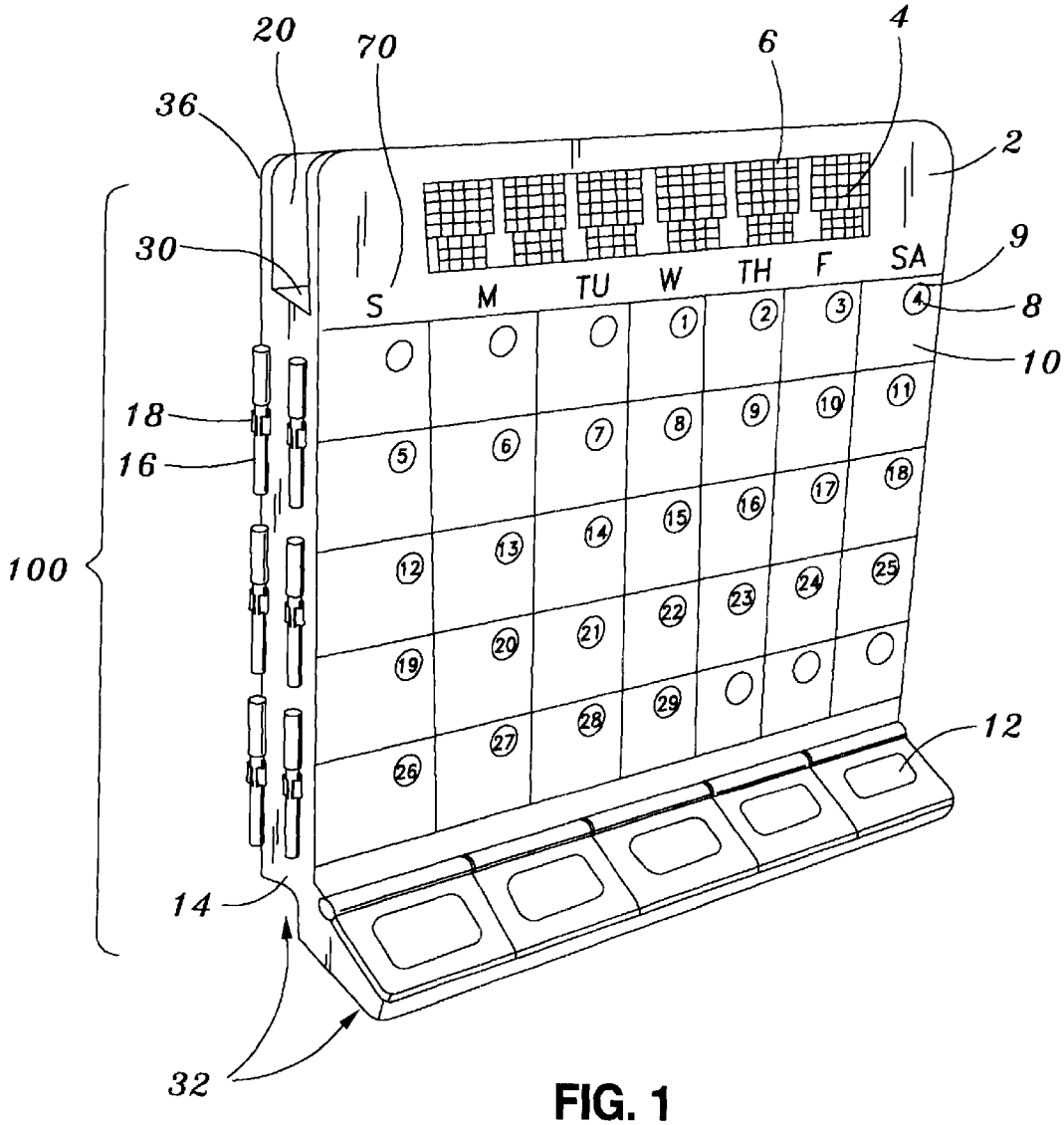
FIG. 1 is a perspective view of the invention.
Figure 2:
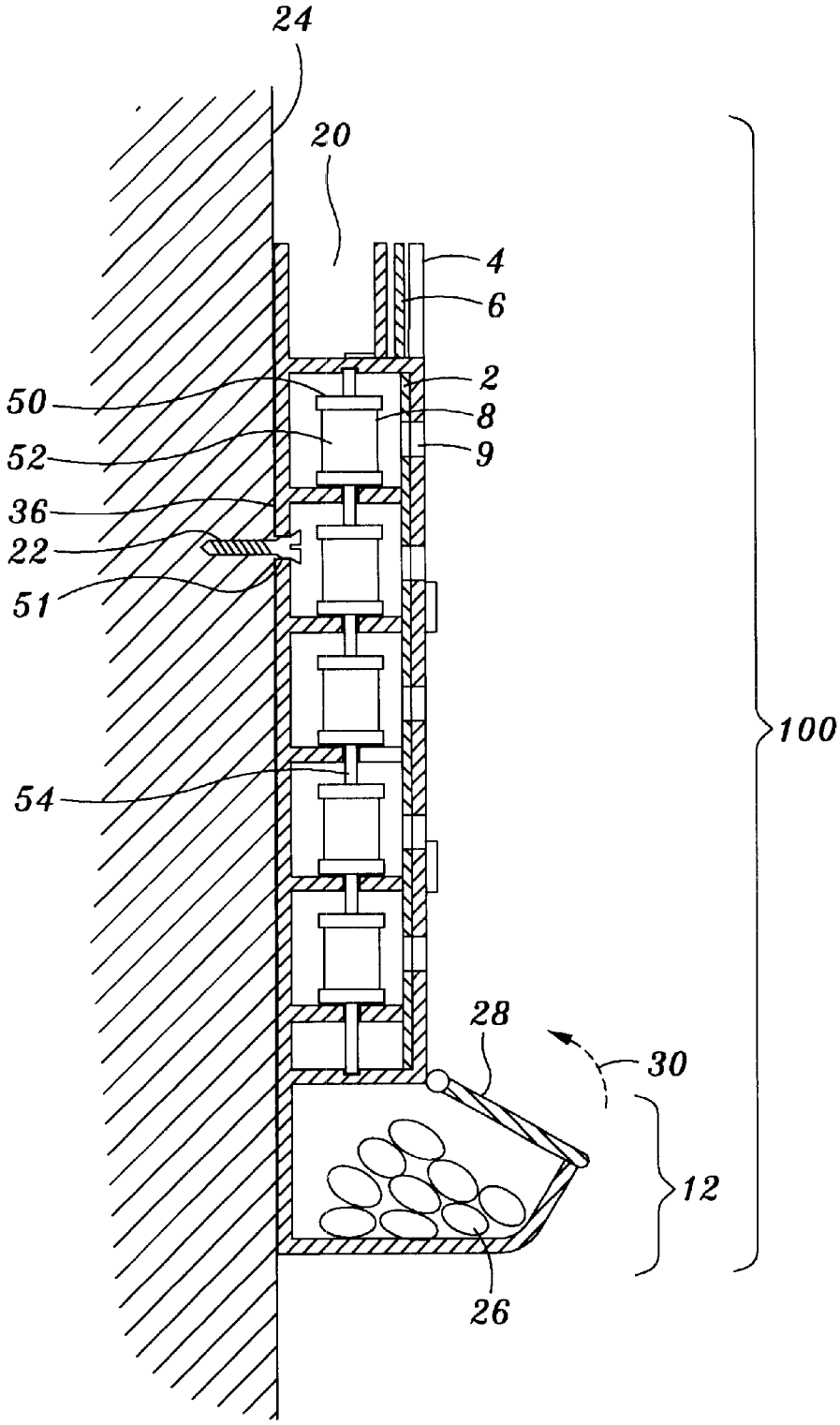
FIG. 2 is a side section view of the invention.
Figure 3:
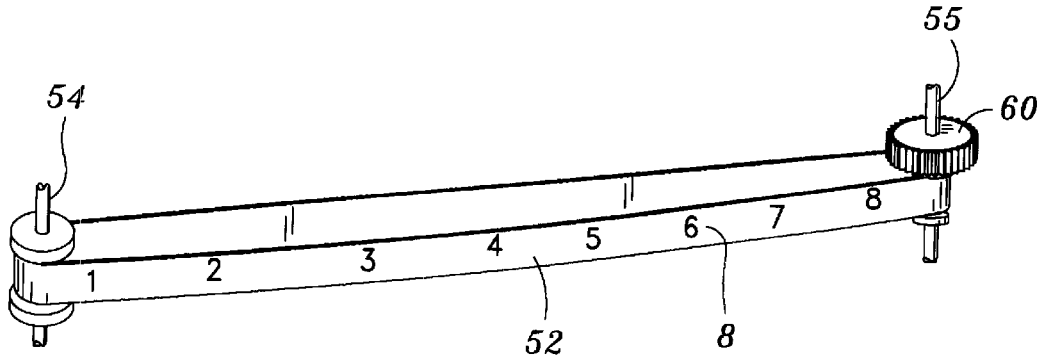
FIG. 3 is a perspective view of one belt assembly that resides in the housing of the invention.
Figure 4:
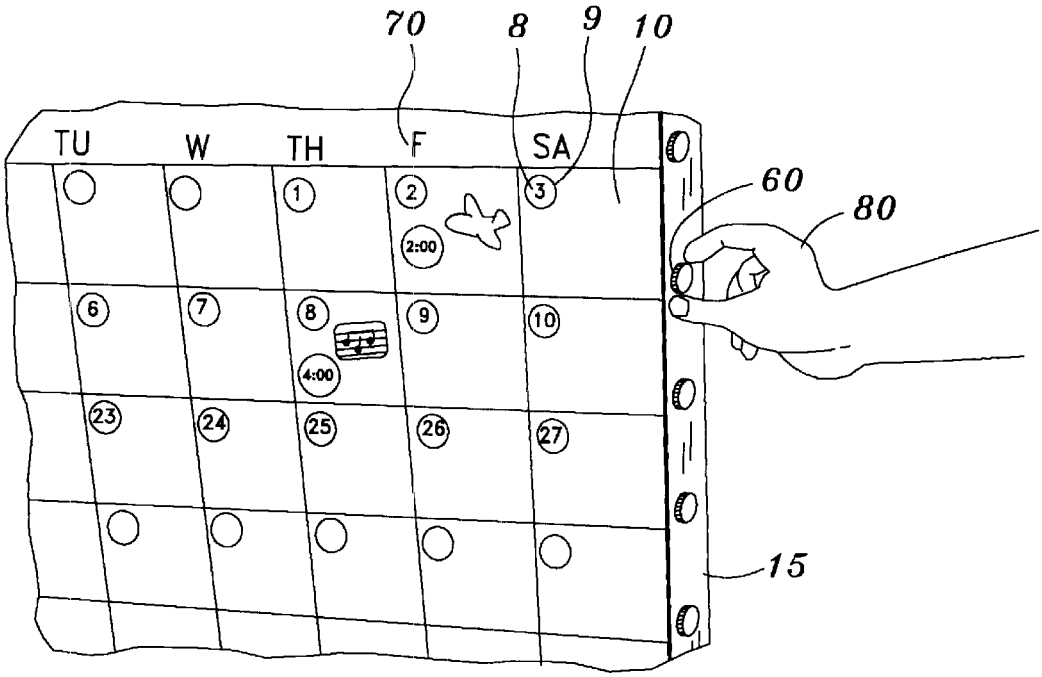
FIG. 4 is a partial perspective view showing the thumb wheels located on the side of the housing.
Figure 5:
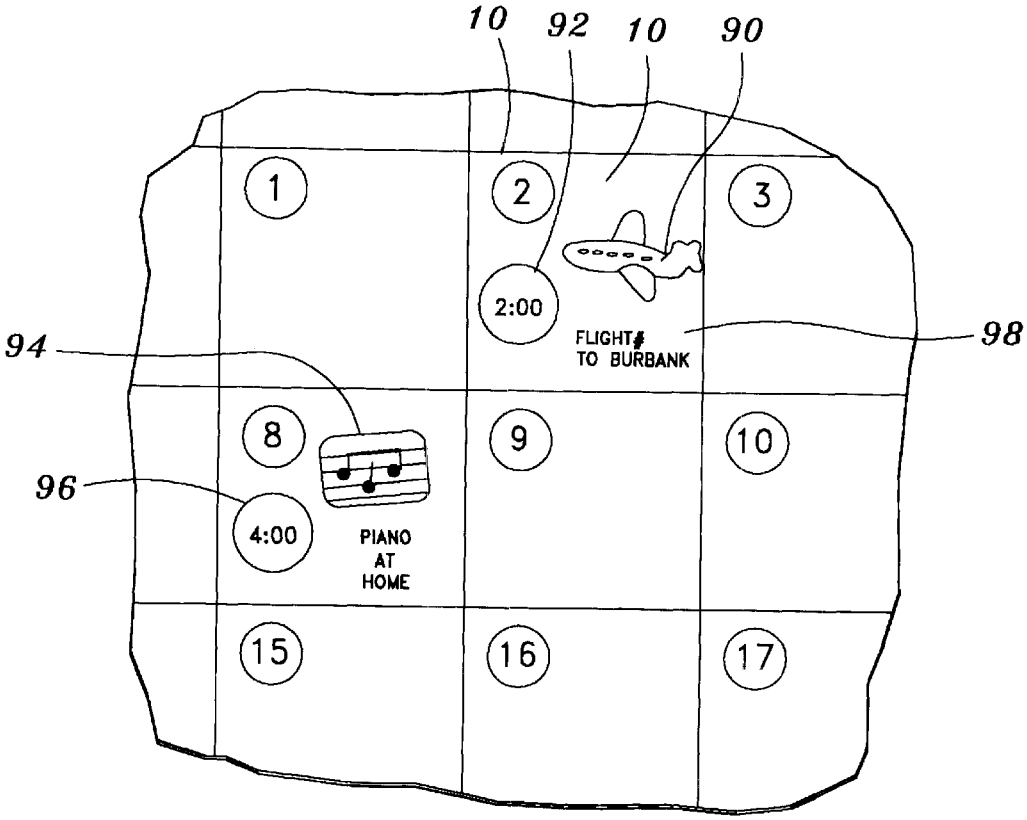
FIG. 5 is a partial front view of the present invention showing the icons used to indicate activities.
Figure 6:
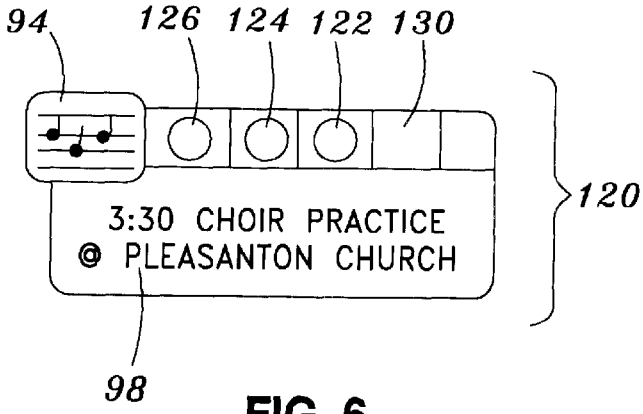
FIG. 6 is a front view of a special multi use icon

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner. Referring now to FIG. 1 we see a perspective view of the calendar planning system of the present invention 100. A main housing has a flat front panel 2, top 30, bottom panel 32 and side panels 14, 15 and rear panel 36. Front panel 2 and rear panel 36 extend upwards beyond top panel 30 thereby creating a pocket 20 which is suitable for storing mail and the like. Front panel 2 is divided graphically into squares 10 each representing a day of the month. The front surface of front panel 2 is coated with a plastic surface that is suitable for use with write on, wipe off type pens 16 which are removably retained in clips 18. A yearly calendar 6 is retained within frame 4. Additional yearly calendars can be stored behind the front calendar 6. Each day box 10 includes an aperture 9 that lets a numeral 8, representing a day of the month, show through from behind the aperture 9. Front panel 2 is made of ferrous metal material so that a magnet can adhere to it. At the base of the main housing are a series of bins 12 that can hold a plurality of icons 26 that help describe activities as will be explained later. FIG. 2 shows a side section view of the present invention 100. An aperture 51 in rear panel 36 allows the housing 100 to be hung on a wall 24 by a nail or screw 22. The main housing can be seen as hollow and containing a series of pulleys 50 and belts 52. The pulleys are supported by a shaft 54. Apertures 9 can be seen allowing numerals 8 to show through. The belts can be moved forward or rearward by hand 80 turning a knob 60 as shown in FIG. 3 and 4. In this way, the user can adjust the numerals 8 so that they line up properly with the weekday indicators 70 as shown in FIG. 1 thereby making the numerals appear in the proper aperture locations 9 in each day square 10. Because of this configuration, only one month calendar panel is needed for all twelve months rather than having a separate panel for each month. One advantage to this configuration is that any items that recur monthly and that may be written or magnetically placed in a day box 10 may remain in the original box 10 from one month to the next. FIG. 5 shows a partial view of front panel 10 A day box 10 can be written on 98 by a write on, wipe off type pen. To save time the user can also select an icon 90, 94 to indicate an activity. For example, icon 90 indicates an airplane trip. Icon 94 represents a music lesson, and so forth. Additional icons 92, 96 can be used to indicate the time of the activity. The icons are color coded and are stored in bins as shown in FIG. 1. Each bin contains one color of icons and each family person is assigned a color so that if one family member is designated orange, he or she would use the orange icons and also write with an orange colored write on, wipe off pen. In this way, the entire family can see at a glance who is planning to be where on any given day and time. A specially designed label 120 can be included in the planning system as shown in FIG. 6 where the label 120 has a magnetic backing and a write on wipe off front surface. An activity icon 94 can be attached to the label 120 and colored dot icons 122, 124, 126 also having magnetic backs can be placed in graphic boxes 130 showing which family members are attending the activity. There is also room to write details 98 of the activity with a write on, wipe off pen. The above description and illustrations show a novel calendar planning system that lets whole families or groups of people record daily activities in an quick, convenient and easily viewable manner.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Calendar Planning System comprising:

a housing including flat front and rear panels, side panels, a bottom and a top panel;

said housing having within it a plurality of horizontally disposed belts and associated pulleys;

said belts having regularly spaced indices printed on them;

said front panel of said housing having a plurality of apertures that allow said indices to appear through said apertures;

said front panel being constructed of a ferrous metal material and coated with a write on wipe off surface;

said front panel being divided graphically into five rows, each row containing seven boxes, thirty-one boxes of said boxes representing the days of the month;

said side panel having a series of rectangular openings that allow thumb wheels mounted on said pulleys to protrude thereby allowing the user to advance or retract said belt thereby advancing or retracting said indices that appear through said front panel apertures;

a plurality of icon retaining bins located at the bottom of said housing; and a plurality of activity indicating color coded icons that each have a magnetic back allowing them to adhere to said front panel.

2. Calendar Planning System as claimed in claim 1 wherein said front and back housing panels extend upward creating a pocket for holding mail and the like.

3. Calendar Planning System as claimed in claim 1 wherein said side housing panel includes a plurality of pen holding clips for removably retaining a plurality of write on, wipe off pens.

4. Calendar Planning System as claimed in claim 1 wherein said extended upper front panel includes a forwardly facing frame that can removably retain a twelve month calendar and retain additional twelve month calendars.

* * * * *